US006666762B2

(12) United States Patent
Richardson

(10) Patent No.: US 6,666,762 B2
(45) Date of Patent: Dec. 23, 2003

(54) VENTILATION SYSTEM

(75) Inventor: Christopher Richardson, Clitheroe (GB)

(73) Assignee: Ultraframe (UK) Limited, Enterprise Works, Lancashire (GB)

( * ) Notice: Subject to any disclaimer, the term of this patent is extended or adjusted under 35 U.S.C. 154(b) by 0 days.

(21) Appl. No.: 09/794,524

(22) Filed: Feb. 27, 2001

(65) Prior Publication Data

US 2001/0029165 A1 Oct. 11, 2001

(30) Foreign Application Priority Data

Feb. 28, 2000 (GB) ..... 0004598

(51) Int. Cl.[7] ..... F24F 7/02

(52) U.S. Cl. ..... 454/346; 454/213; 454/350; 454/351; 454/353

(58) Field of Search ..... 454/200, 213, 454/341, 346, 347, 350, 351, 352, 353, 354, 355

(56) References Cited

U.S. PATENT DOCUMENTS 2,349,668 A * 5/1944 Marker et al.
3,080,695 A * 3/1963 Hay
3,085,490 A * 4/1963 Field
3,275,224 A * 9/1966 Bush
3,331,304 A * 7/1967 Baus

FOREIGN PATENT DOCUMENTS

| | | |
|---|---|---|
| EP | 0840069 A1 | 5/1998 |
| FR | 2701279 | 8/1994 |
| GB | 2101654 A | 1/1983 |
| GB | 2155616 A | 9/1985 |
| GB | 2307739 A | 6/1997 |
| JP | 08285314 | 11/1996 |
| JP | 10246234 A | 9/1998 |
| WO | WO 99/28571 | 6/1999 |

* cited by examiner

*Primary Examiner*—Harold Joyce

(57) ABSTRACT

A power assisted ventilation system for a conservatory of the type having a roof extending away from a wall or other supporting structure that is mountable where the roof meets the wall of other supporting structure has a back plate mountable to the wall or to a glazing panel support means already on the wall and an apertured cover securable to the back plate.

7 Claims, 7 Drawing Sheets

VENTILATION SYSTEM

This invention concerns a ventilation system suitable for use in a conservatory roof.

For a conservatory roof having a central ridge it is convenient to locate a power assisted ventilation system in the ridge for extraction of hot and/or stale air. But in a conservatory roof of the type having a roof sloping from a wall or other structure there is no corresponding position for a ventilation system.

This invention provides, in a conservatory having a wall and having a roof, an arrangement wherein a supporting structure, which is adapted to support the roof, is mounted to the wall so as to define an air flow space between the supporting structure and the wall and wherein a power assisted ventilation system is mounted to the supporting structure and is arranged to direct air flow into the air flow space.

Preferably, the supporting structure comprises a channel member, which is mounted to the wall via spaced brackets, which define the air flow space between the channel member and the wall. Preferably, a power assisted ventilation system includes a cowl, which is arranged to direct air flow into the air flow space.

Preferably, the power assisted ventilation system includes a one-way valve allowing air flow from the power assisted ventilation system into the air flow space but not allowing reverse air flow. Preferably, the one-way valve is a flap valve.

This invention will now be further described by way of example only, with reference to the accompanying drawings, in which.

Figure 1:
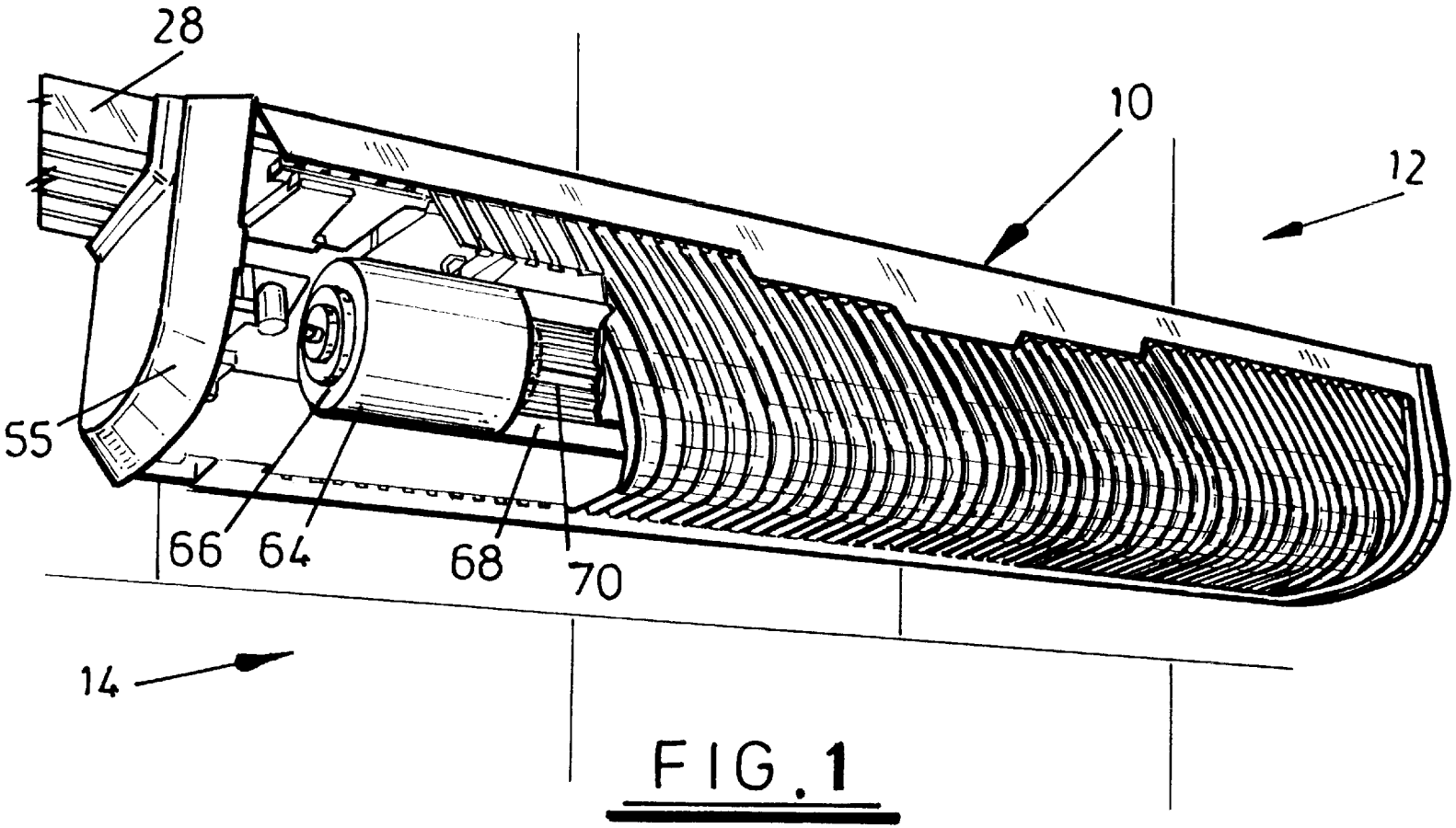
FIG. 1 shows a ventilation system for a conservatory roof.
Figure 2:
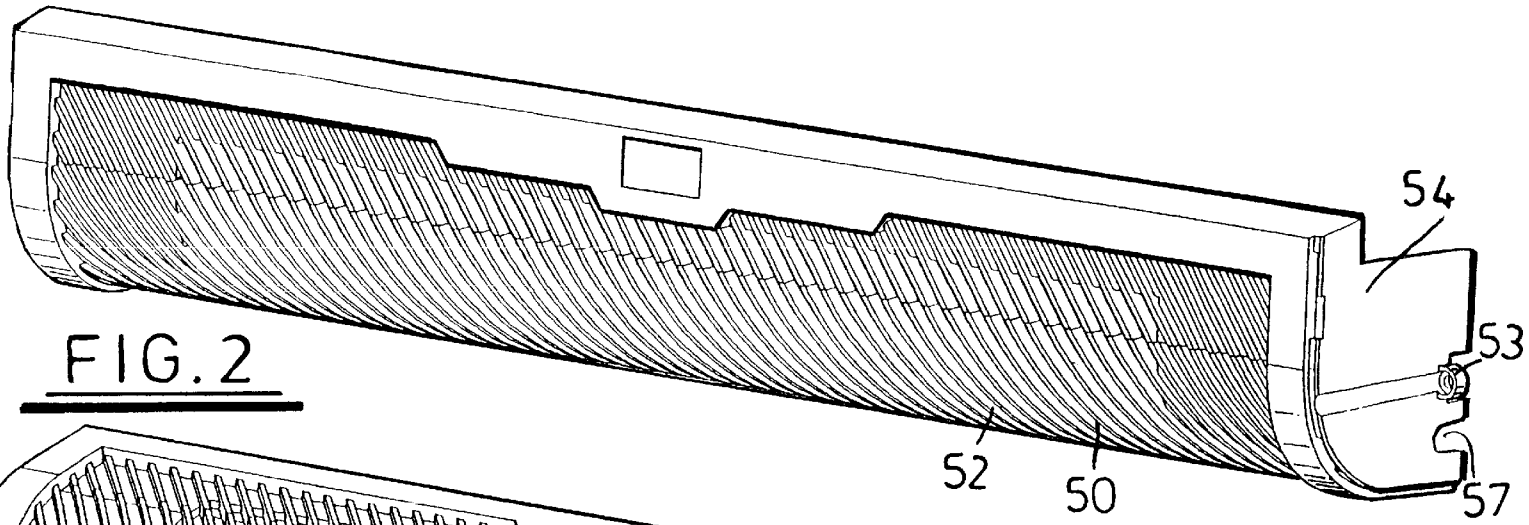
FIG. 2 is a front view of the cover of the system of FIG. 1.
Figure 3:
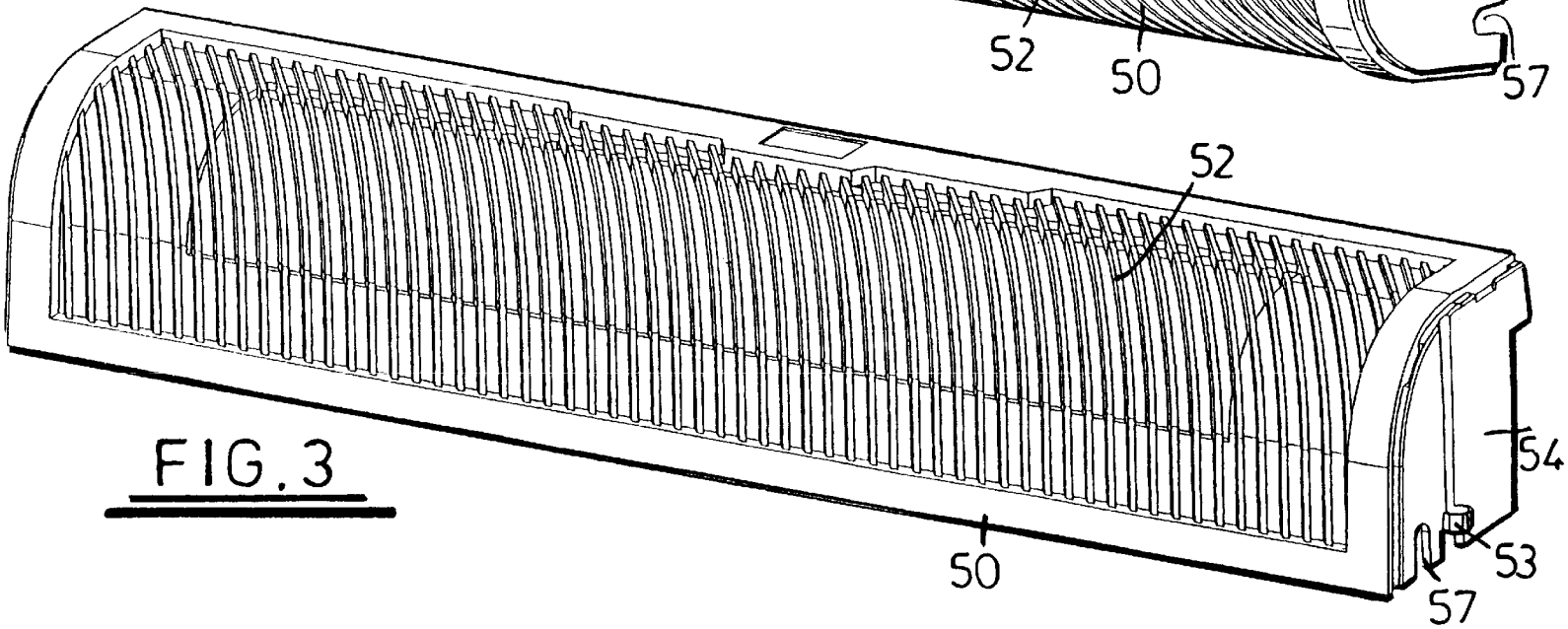
FIG. 3 is a bottom view of the cover of FIG. 2.
Figure 4:
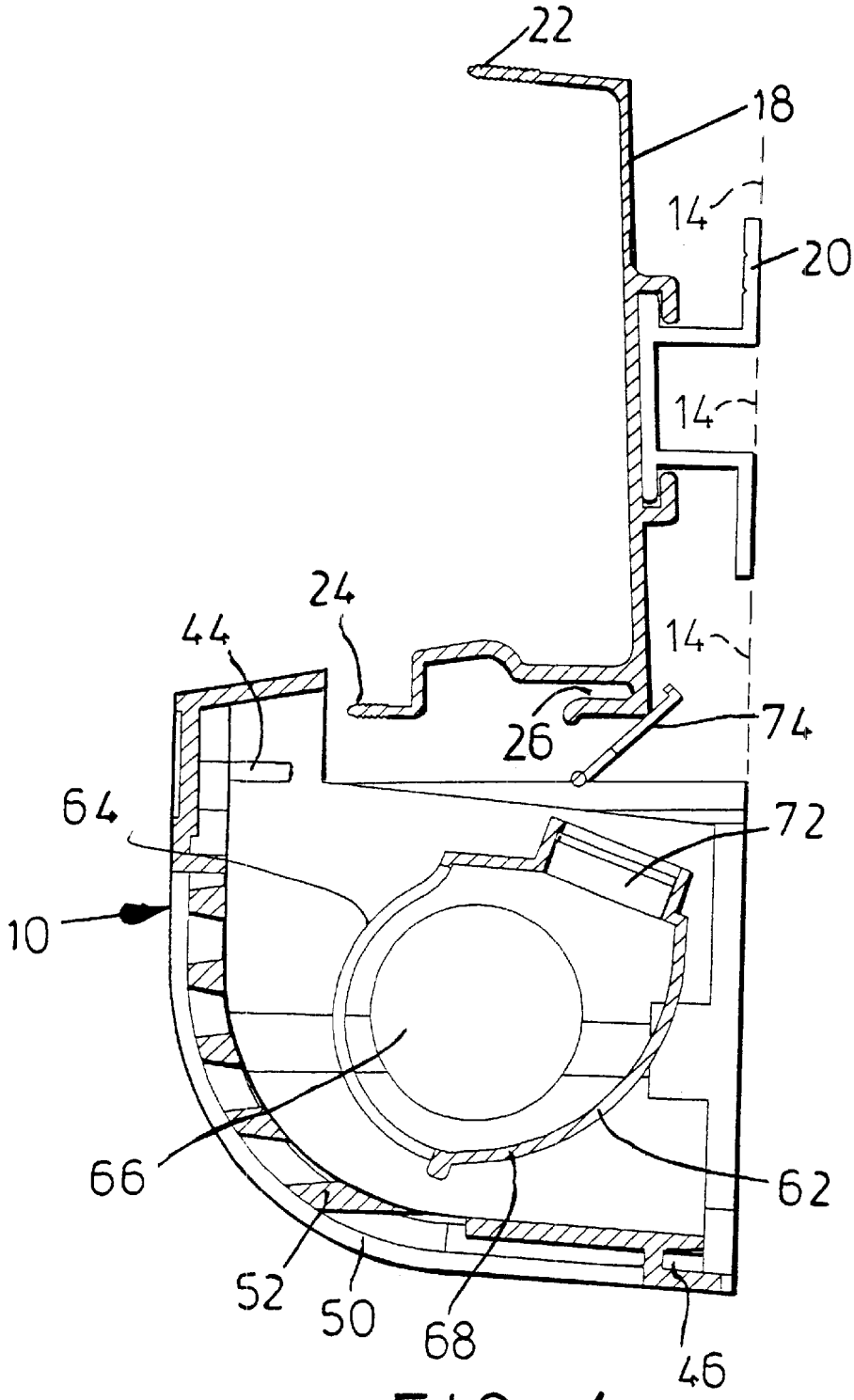
FIG. 4 is a first section through the ventilation system of FIG. 1.
Figure 5:
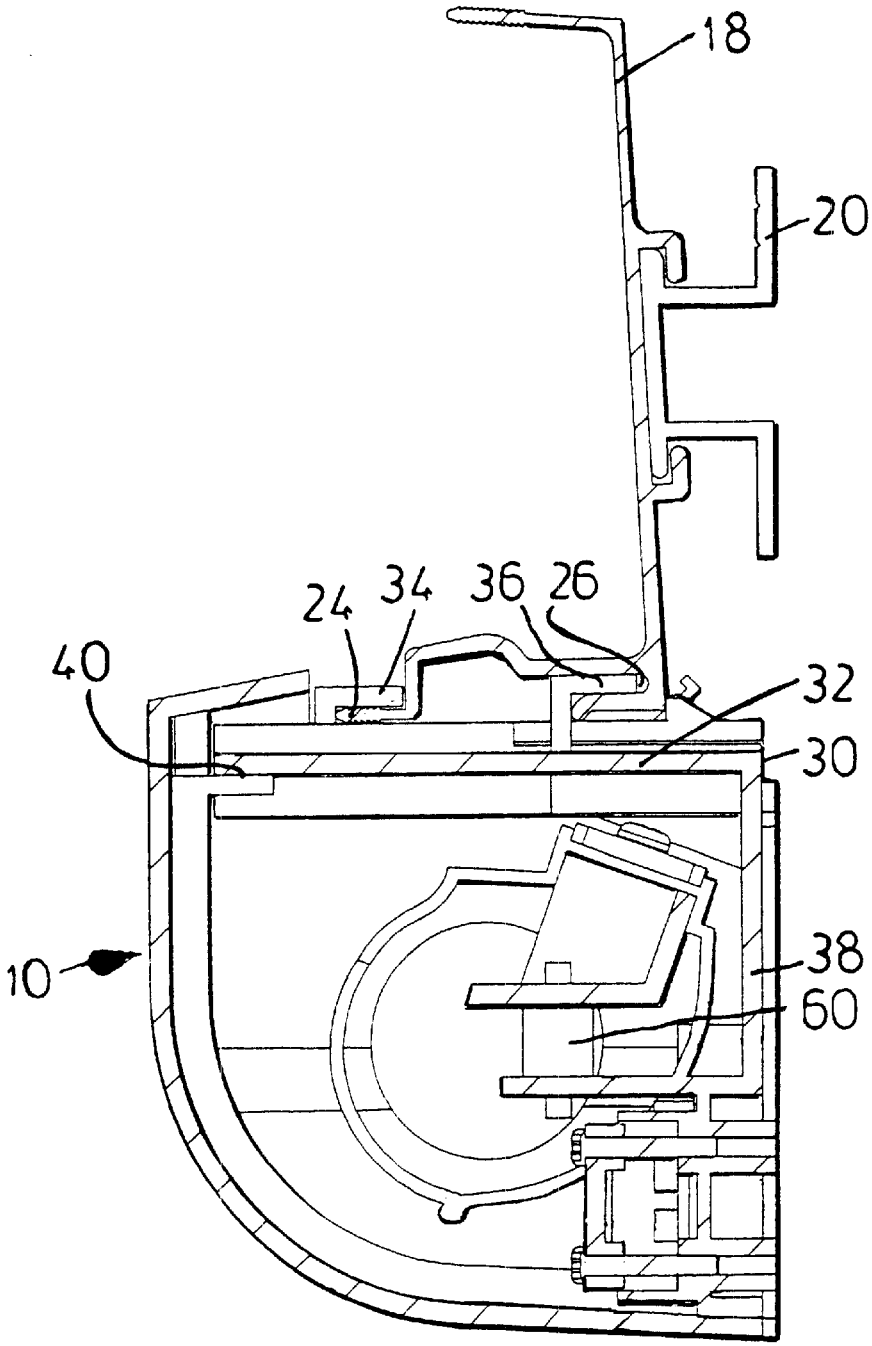
FIG. 5 is a second section through the ventilation system of FIG. 1.
Figure 6:
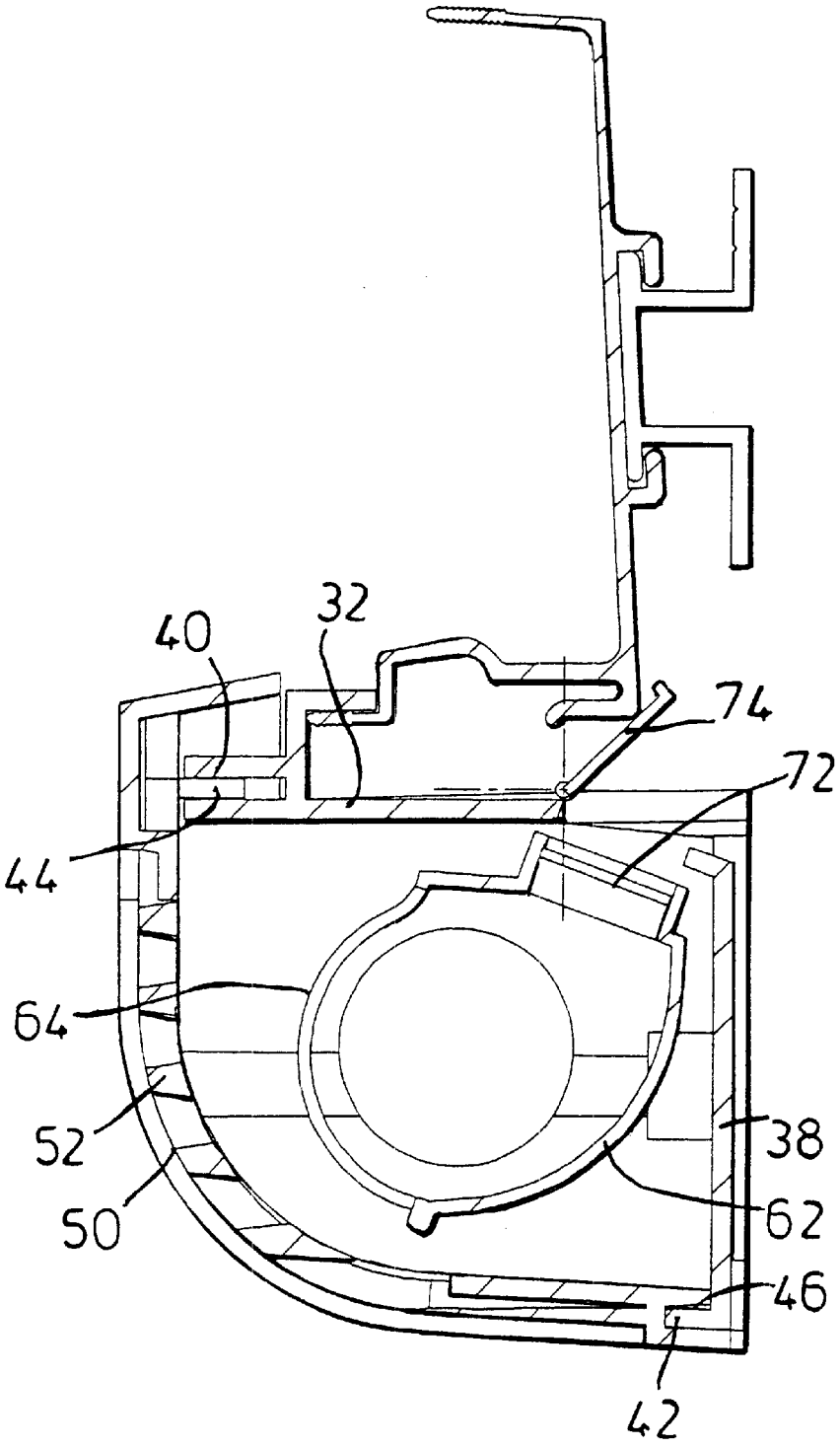
FIG. 6 is a third section through the ventilation system of FIG. 1.
Figure 7:
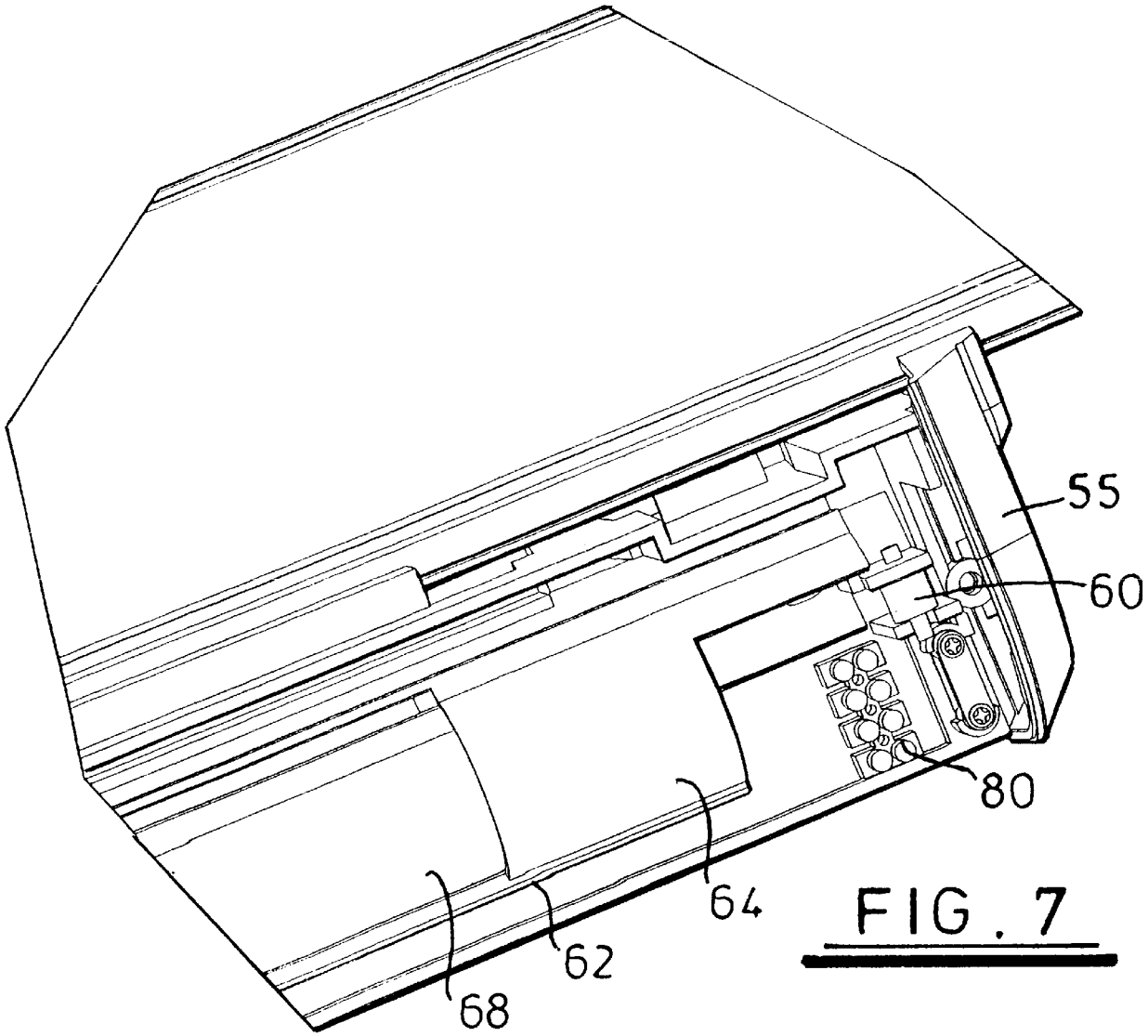
FIG. 7 shows part of the system of FIG. 1 with the cover removed.
Figure 8:
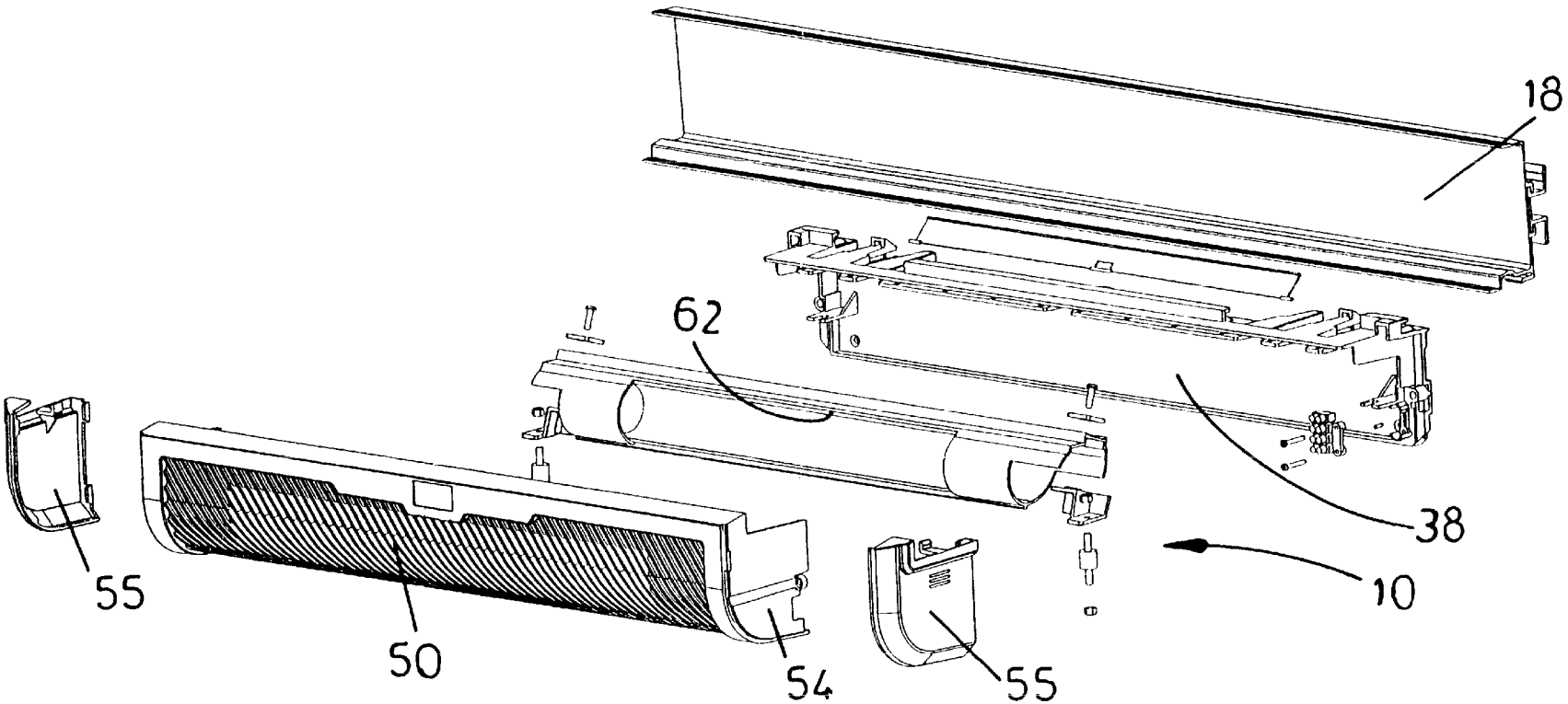
FIG. 8 is an exploded view of the ventilation system of FIG. 1.

The ventilation system illustrated aims to overcome the abovementioned problem by being locatable where the roof meets the wall. The roofing panels (not shown in FIGS. 4 and 5) are supported by a supporting structure comprising channel members 18 that are mounted in spaced brackets 20 which are screwed to the wall 14 and which define an air flow space S (see FIG. 4) between the supporting structure and the wall, i.e., between the channel members 18 and the wall 14. Not shown is a capping that prevents rain ingress but permits air flow in the air flow space S, behind the channel members 18, and between the brackets 20.

The channel member 18 has a top barb 22 onto which the capping can be located, a bottom barb 24, and a slot 26 onto which undercladding (not shown) can be located. The latter barb 24 and the slot 26 are used to support the ventilation system.

The system 10 comprises a generally inverted L-shaped back plate 36 having a top web 32 with a pair of spaced L-shaped ribs 34, 36, the first rib 34 locating over barb 24 and the second rib 36 locating in the slot 26 of the channel member 18. The other web 38 of the back plate depends from the first web and is fixed to the wall.

The free end of top web 32 is slotted (40) and the free end of the other web 38 has a lip 42. The slot 40 and lip 42 serve as locations respectively for cooperating rib 44 and slot 46 along top and bottom edges of cover 50. The cover 50 is in the form of a grill formed by angles slats 52. The cover is screwed to the back plate via screw holes 53 in ends 42 of the cover and snap-on end covers 55 are provided to conceal the screws and electrical wiring for the ventilation system that can be run behind the undercladding. The ends 54 have cut outs 57 for electrical wiring to pass through.

Mounted to the back plate via anti-vibration mountings 60 at each end is a cowl 62 having a cylindrical first part 64 containing a rotary motor 66 and a second open fronts part 68 in which is an axial fan 70 operated by the motor. The second part 68 of the cowl is shaped to direct air flow upwards through longitudinal slot 72 in the top of the cowl.

Directly above the slot 72, the top web of the back plate has a one-way flap valve 74 following air flow into the air flow space S and out behind the channel member 18 but not allowing reverse air flow. At one end of the ventilation system are electrical terminals 80 for connecting an external power supply to the motor 66.

The ventilation system illustrated can be fitted to a conservatory roof in a relatively unobtrusive fashion and is used to remove hot or stale air from within the conservatory to maintain pleasant conditions therein. By mounting the roof cowl on anti-vibration mountings noise levels can be kept down because operation of the ventilation system will have minimal vibrating effects on the roof itself.

What is claimed is:

1. In a conservatory having a wall and having a roof, which meets the wall, an arrangement comprising a supporting structure supporting the roof, mounted to the wall, beneath the roof, and spaced from the wall so as to define an air flow space behind the supporting structure, the arrangement further comprising a power assisted ventilation system mounted to the supporting structure, where the roof meets the wall, and arranged to direct air flow into the air flow space.

2. The arrangement of claim 1 wherein the supporting structure comprises a channel member, which is mounted to the wall via spaced brackets defining the air flow space.

3. The arrangement of claim 1 wherein the power assisted ventilation system includes a cowl, which is arranged to direct air flow into the air flow space.

4. The arrangement of claim 2 wherein the power assisted ventilation system includes a cowl, which is arranged to direct air flow into the air flow space.

5. The arrangement of claim 1, 2, 3, or 4 wherein the power assisted ventilation system includes a one-way valve allowing air flow from the power assisted ventilation system into the air flow space but not allowing reverse air flow.

6. The arrangement of claim 5 wherein the one-way valve is a flap valve.

7. The arrangement as claimed in any preceding claim, wherein the roof is attached to the wall and slopes downwardly.

* * * * *